US006131625A

United States Patent [19]

Casanova et al.

[11] Patent Number: 6,131,625

[45] Date of Patent: Oct. 17, 2000

[54] COIN BAG CLAMPING DEVICE

[75] Inventors: Scott D. Casanova, Roselle; Bogdan Kowalczyk, Bloomingdale; John C. Peklo, Elmhurst; John S. Staszczak, Lincolnwood; Joseph J. Geib, Mt. Prospect, all of Ill.

[73] Assignee: Cummins-Allison Corporation, Mount Prospect, Ill.

[21] Appl. No.: 09/253,091

[22] Filed: Feb. 19, 1999

[51] Int. Cl.[7] ..... B65B 1/04

[52] U.S. Cl. ..... 141/314; 248/95; 453/63

[58] Field of Search ..... 248/95, 99, 101; 453/63; 141/314, 315, 316

[56] References Cited

U.S. PATENT DOCUMENTS

| | | | |
|---|---|---|---|
| D. 294,597 | 3/1988 | Lanagan | D18/3 |
| 617,961 | 1/1899 | Johnson | 248/101 |
| 2,307,181 | 1/1943 | Young | 383/22 |
| 3,960,314 | 6/1976 | Faiers | 229/62 |
| 4,610,053 | 9/1986 | Tomita | 24/30.5 |
| 4,863,414 | 9/1989 | Ristvedt et al. | 453/6 |
| 4,895,402 | 1/1990 | Tomita | 292/307 |
| 5,011,455 | 4/1991 | Rasmussen | 453/10 |
| 5,031,808 | 7/1991 | Dolenc | 248/95 |
| 5,123,873 | 6/1992 | Rasmussen | 453/10 |
| 5,141,443 | 8/1992 | Rasmussen | 453/10 |
| 5,297,598 | 3/1994 | Rasmussen | 41/314 |
| 5,443,419 | 8/1995 | Adams et al. | 453/17 |
| 5,501,632 | 3/1996 | Adams et al. | 453/3 |
| 5,542,880 | 8/1996 | Geib et al. | 453/10 |
| 5,830,056 | 11/1998 | Adams et al. | 453/63 |
| 5,865,673 | 2/1999 | Geib et al. | 453/10 |

*Primary Examiner*—Ramon O. Ramirez
*Attorney, Agent, or Firm*—Stephen G. Rudisill; Jenkens & Gilchrist

[57] ABSTRACT

The present invention is directed to a clamping device for a coin bag that receives coins from a coin exit region of a coin processing machine. The clamping device includes a mounting structure that is located at the coin exit region. The mounting structure has first and second outer surfaces that are generally angled with respect to a vertical line. A holder member movably mounted with respect to the mounting structure between an opened position and a closed position. The holder member has first and second inner surfaces generally opposing the outer surfaces of the mounting structure when the holder member is in the closed position. A bag receiving region is defined between the first inner and outer surfaces and between the second inner and outer surfaces. The bag receiving region decreases in size when the holder member is moved from the opened position to the closed position where the bag is clamped tightly between the inner and outer surfaces. To release the holder member from the mounting structure when the two components are clamping a bag, the bag clamping device includes a cam. A lever is attached to the cam for manual actuation by the operator. When actuated, the cam engages the mounting structure to force the holding member away from the mounting structure and release the bag.

43 Claims, 4 Drawing Sheets

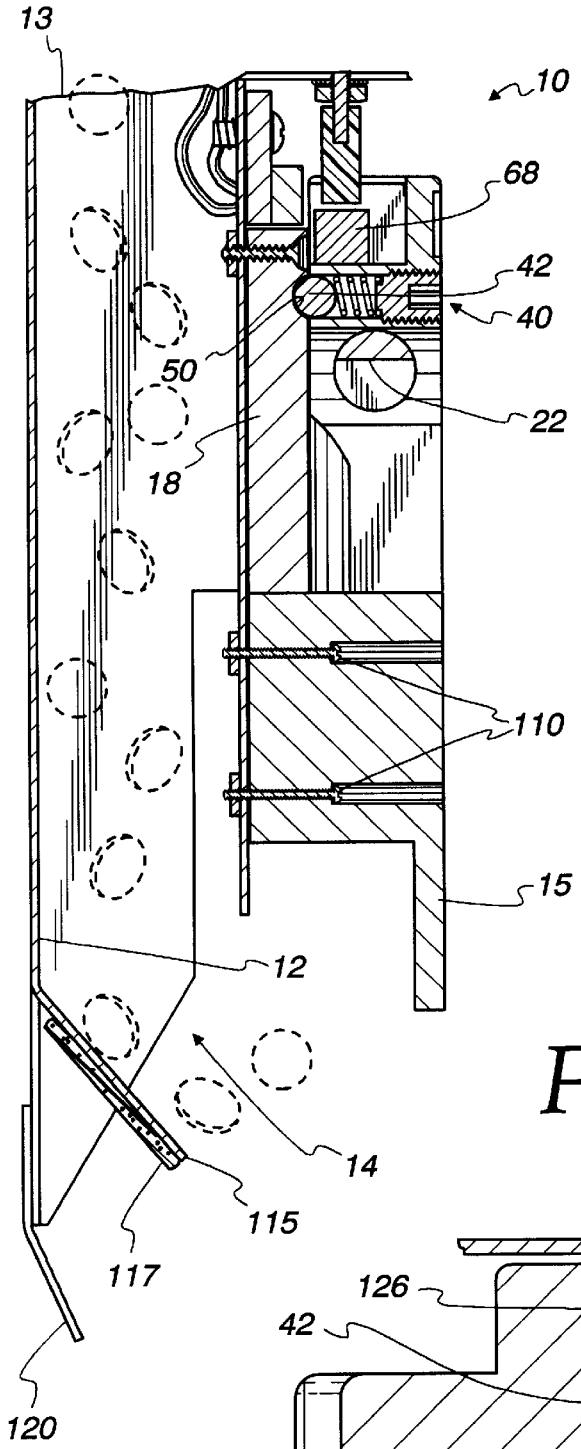
Fig. 5
Fig. 6
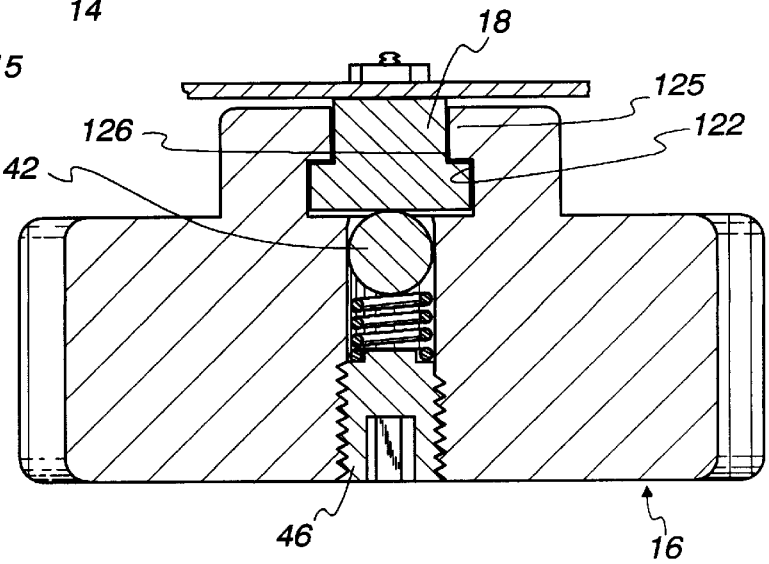

COIN BAG CLAMPING DEVICE

FIELD OF THE INVENTION

The present invention relates generally to coin processing devices such as coin sorters and, in particular, to a mechanism for holding and releasing coin bags which collect the processed coins.

BACKGROUND OF THE INVENTION

There are many types of coin processing machines which deliver coins at high speeds into awaiting coin collecting containers. For example, coin sorters receive mixtures of coins and separate them into their respective denominations. Each of these coin denominations has a coin collecting container located at a coin exit region which receives the coins as they are discharged from the coin sorter. The majority of these coin collecting containers are cloth or plastic bags which are supported by a bag clamping device.

Many bag clamping devices presently available can be cumbersome to use and require a great deal of manual dexterity to properly position the bag prior to clamping it. Since gravity moves the coins from a coin processing machine downwardly, the bag clamping devices are often located on the lower portions of coin processing machines which may hinder the operator's ability to visualize the bag clamping device. Because the bags are often quickly removed and replaced, the visibility and dexterity requirements of many existing bag clamping devices impair their functionality. Further, the weight of filled coins bags can further frustrate the use of existing bag clamping devices during the bag removal process.

Furthermore, another problem of coin processing machines, especially coin sorters, is that these machines require a fair amount of space. Accordingly, the industries which commonly use coin processing machines are demanding machines with a smaller footprint. As the size of coin processing machines is reduced, the space allocated to bag holding devices is also reduced.

A need exists for a compact bag holding device that simplifies the installation and removal operations for the coin bags.

SUMMARY OF THE INVENTION

The present invention is a clamping device for a coin bag that receives coins from a coin exit region of a coin processing machine. The clamping device includes a mounting structure that is located at the coin exit region. The mounting structure has first and second outer surfaces that are generally angled with respect to a vertical line.

The clamping device further includes a holder member movably mounted with respect to the mounting structure between an opened position and a closed position. The holder member has first and second inner surfaces generally opposing the outer surfaces of the mounting structure when the holder member is in the closed position. Preferably, the holder mechanism and the mounting structure are directly attached to a coin chute which receives the coins from the coin exit region of the coin processing machine and discharges them to the coin bag. Also, the coin chute may include a guide structure along which the holder member slides between its opened and closed positions.

A bag receiving region is defined between the first inner and outer surfaces and between the second inner and outer surfaces. The bag receiving region decreases in size when the holder member is moved from the opened position to the closed position where the bag is clamped tightly between the inner and outer surfaces. As the bag is filled, the weight of the coins tends to pull downwardly on the inner surfaces of the holding mechanism. Thus, the clamping force exerted on the bag increases as the bag is filled.

To release the holder member from the mounting structure when the two components are clamping a bag, the bag clamping device includes a cam that is preferably mounted within the holder member. When actuated, the cam engages the mounting structure to force the holding member away from the mounting structure. Preferably, a lever is attached to the cam so that the operator manually releases the bag from the clamping engagement of the holder member and the mounting structure.

The invention will now be described in greater detail with reference to the accompanying drawings which illustrate exemplary embodiments of the invention.

BRIEF DESCRIPTION OF THE DRAWINGS

FIG. 5 is a cross-sectional view of the bag clamping device taken along line 5—5 of FIG. 2; and FIG. 6 is a cross-sectional view of the guide mechanism taken along line 6—6 of FIG. 3.

Figure 1:
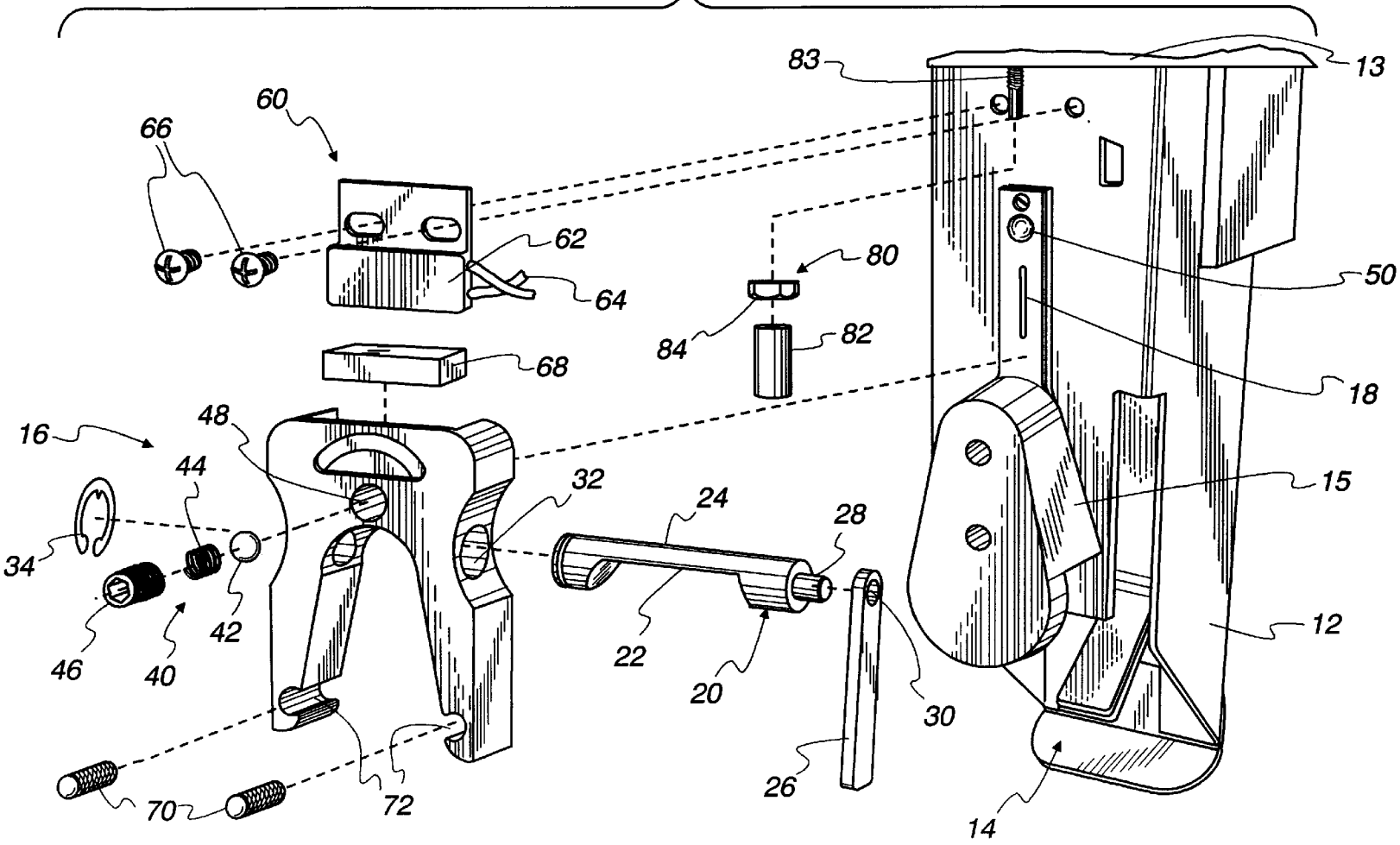
FIG. 1 is an exploded perspective view of a bag clamping device embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed. To the contrary, the intention is to cover all modifications, equivalents, and alternatives falling within the spirit and scope of the invention as defined by the appended claims.

DETAILED DESCRIPTION OF THE DRAWINGS

Referring to FIG. 1, a bag clamping device 10 includes a coin chute 12 with a chute opening 13 which receives coins from coin exit region of a coin processing machine and a chute exit 14 where coins are discharged from the coin chute 12 into a coin bag. The bag clamping device 10 includes a mounting structure 15 that is preferably attached to the coin chute 12 through fasteners (shown in FIG. 1) or that is integral with the coin chute 12. However, the mounting structure 15 may be independent of the coin chute 12. The bag clamping device 10 further includes a holder member 16 which moves relative to the mounting structure 15 along a guide structure 18. The relationship between the holder member 16 and guide structure 18 are shown in detail in FIG. 6.

The bag clamping device 10 also includes a cam 20 in the form of a rotating pin having a mid-section that is removed so as to define a clearance surface 22 and an actuating surface 24. In cross-section, the cam 20 has a semi-circular shape, although numerous other shapes would work as well. A lever 26 is fixedly mounted to the cam 20 through a pin 28 at the end of the cam 20 which extends through an opening 30 in the lever 26. The cam 20 is positioned through a cam bore 32 within the holder member 16 and is held there by a retaining ring 34 on the opposite side of the cam bore 32. The functionality of the cam 20 will be described in detail with reference to FIGS. 3 and 4.

The holder member 16 further includes a detent mechanism 40 which locks the holder member 16 in its opened position as it slides along the guide structure 18. The detent mechanism 40 includes a ball 42 in contact with a spring 44 that is compressed through a screw 46. The ball 42, the spring 44, and the screw 46 are disposed within a detent bore 48 of the holder member 16. In operation, the ball 42 extends through the back side of the detent bore 48 and engages a ball recess 50 on the guide structure 18 as shown in detail with reference to FIGS. 5 and 6.

The bag clamping device 10 may also include a bag-off sensor assembly 60. The bag-off sensor assembly 60 includes a sensor 62 which has connector leads 64 that are in electrical communication with a control system for the coin processing machine. The sensor 62 is mounted on the coin chute 12 through fasteners 66. The bag-off sensor assembly 60 also includes a magnet 68 which is positioned on the movable holder member 16. In operation when the holder member 16 is moved to its upper position along the guide structure 18, the magnet 68 is positioned directly adjacent to the sensor 62. There, the magnetic field produced by the magnet 68 causes a toggling of the switch within the sensor 62 which is then detected by the control system of the coin processing machine. Detecting that the holder member 16 is in the uppermost position such that no coin bag is attached to the coin chute 12, the coin processing machine then diverts the coins which would normally be directed to the coin chute 12 as the operator installs a new bag on the coin chute 12.

The holder member 16 also includes two bores 72 at its lower region which receive knurled pins 70. The knurled pins 70 are configured such that a portion of their exterior surface extends slightly inwardly from the inner surfaces of the holder member 16 to increase the gripping of the coin bag.

The bag clamping device 10 may also include a stop assembly 80 which limits the vertical movement of the holder member 16 as it slides along the guide structure 18. The stop assembly 80 includes a tubular element 82 which fits over a rod 83. The rod 83 may be a screw which is used in conjunction with a nut 84 to hold the coin chute 12 to the coin processing machine. Once the nut 84 is fully threaded onto the rod 83 and the coin chute 12 is secured to the coin processing unit, the tubular element 82 can then be placed over the rod 83. The tubular element 82 may also include internal threads for threadably engaging the threads of the rod 83 so that the maximum vertical position of the holder member 16 as it slides along the guide structure 18 can be adjusted.

Figure 2:
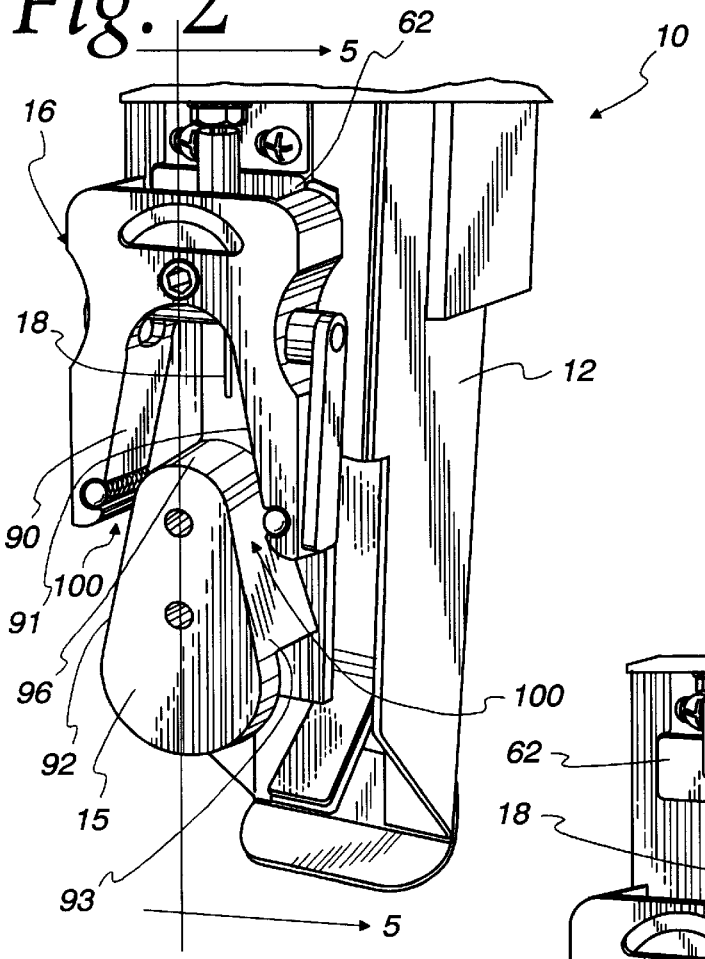
FIG. 2 is a perspective view of the bag clamping device in its opened state.
Figure 4:
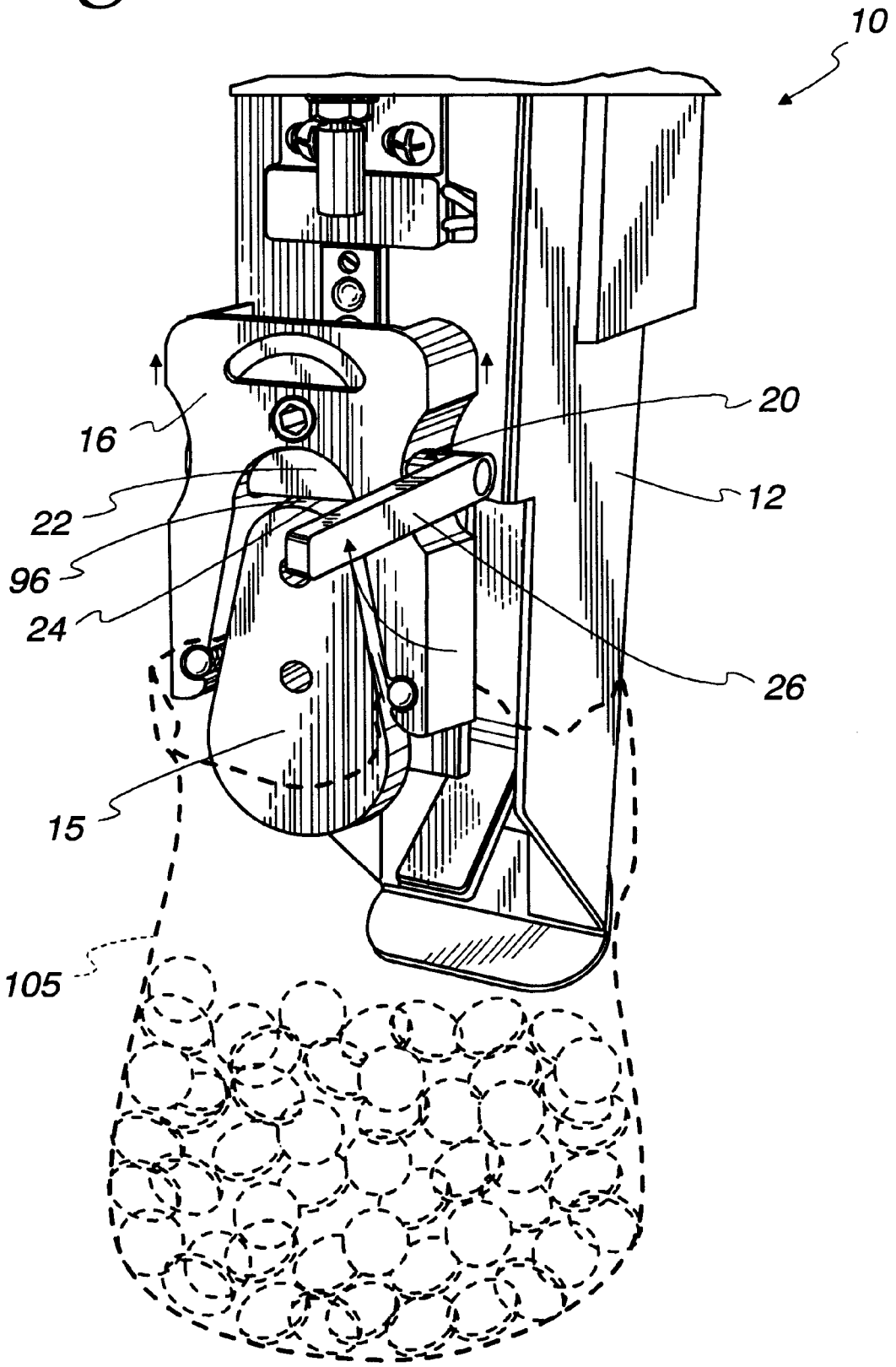
FIG. 4 is a perspective view of the bag clamping device in the process of releasing a filled coin bag.

FIG. 2 illustrates the bag clamping device 10 in its opened state whereby a bag can be inserted between the holder member 16 and the mounting structure 15. The holder member 16 has first and second inner surfaces 90 and 91 while the mounting structure 15 has complementary first and second outer surface 92 and 93. The inner surfaces 90 and 91 of the holder member 16 are at approximately the same angles with respect to an imaginary vertical line (i.e. typically the direction of the gravity gradient) as their complementary outer surfaces 92 and 93 on the mounting structure 15. However, the inner surfaces 90 and 91 may be at different angles as well. In one preferred embodiment, the inner and outer surfaces 90–93 make an angle with a vertical line that is in the range from about 10° to about 15°. As such, the cut-out in the holder member 16 is generally an inverted V-shape while the mounting structure 15 is also generally an inverted V-shape. While the inner and outer surfaces 90–93 are illustrated as flat, they also can be made with a curvature as well. Between the first and second outer surfaces 92 and 93 of the mounting structure is a cam engaging surface 96 which is used in conjunction with the cam 20 as shown in FIG. 4.

Between the first inner surface 90 and first outer surface 92 and between the second inner surface 91 and second outer surface 93 is a bag receiving region 100. The operator of the coin processing machine inserts the flaps at the opening of the bag into the bag receiving region 100 so that they can be clamped by the bag clamping device 10. In its open state, the holder member 16 is locked in its upper position via the detent mechanism 40 with the magnet 68 (not shown) directly adjacent to the sensor 62. Accordingly, the control system for the coin processing machine detects that the holder member 16 is in its upper position and that no bag is attached to the coin chute 12.

Figure 3:
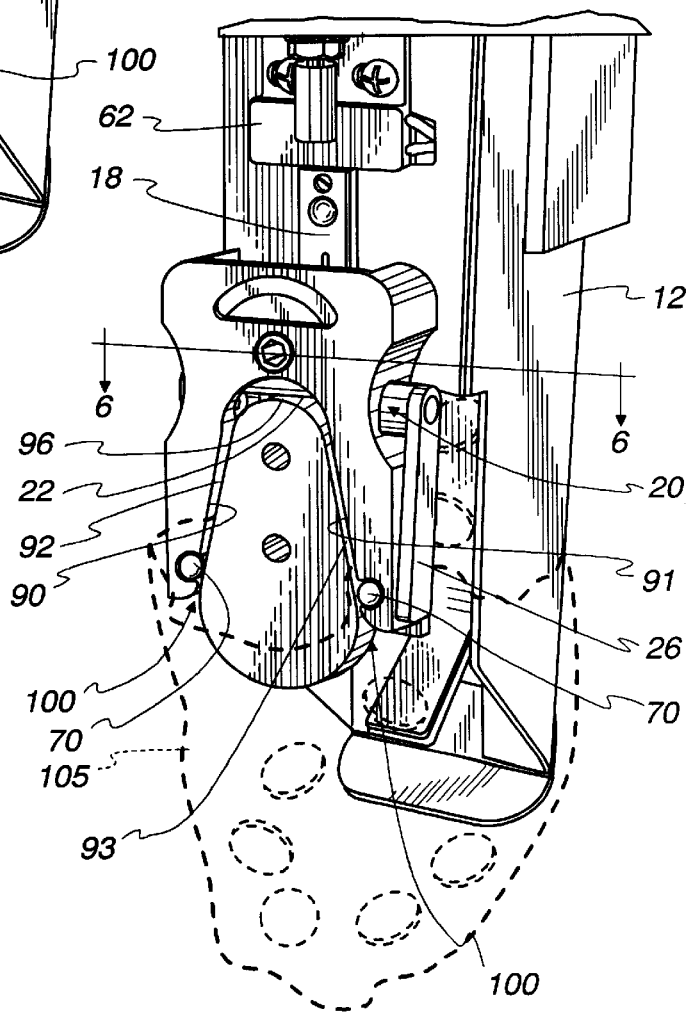
FIG. 3 is a perspective view of the bag clamping device in its closed state during which a bag is being clamped.

FIG. 3 illustrates the bag clamping device 10 in its closed state with a bag 105 clamped between the mounting structure 15 and the holder member 16. The bag 105 is held tightly between the first inner surface 90 and the first outer surface 92 and also between the second inner surface 91 and second inner surface 93. The knurled pins 70 are also useful in tightly engaging the bag 105, especially when the bag is made of a polymeric material. The inner and outer surfaces 90–93 may also be roughened to provide additional gripping. As can be seen by comparing FIG. 2 and FIG. 3, the size of the bag receiving region 100 is significantly reduced when the holder member 16 is moved downwardly along the guide structure 18 into its closed (clamping) position. FIG. 3 also illustrates lever 26 extending downwardly adjacent to the holder member 16 when the cam 20 is in its non-operational position. In this non-operational position, the clearance surface 22 is positioned away from the cam engaging surface 96.

As each coin moves from the coin chute 12 into the bag 105, the bag 105 becomes heavier. As such, the bag 105 pulls downwardly against the bag clamping device 10 under the force of gravity. Thus, the bag 105 is also pulling downwardly on the holder member 16 due to the frictional force between the exterior of the bag 105 and the inner surfaces 90 and 91 of the holder member 16. Accordingly, as the bag 105 becomes heavier, the clamping force produced by the holder member 16 and the mounting structure 15 increases. Thus, it is easier to move the holder member 16 away from the mounting structure 15 when the bag 105 is empty.

FIG. 4 illustrates the bag clamping device 10 when a coin limit has been reached in the coin bag 105 and the operator is required to remove the bag 105 from the coin chute 12. As stated in the previous paragraph, as the number of coins in the bag 105 increases, the clamping force produced by the holder member 16 in combination with the mounting structure 15 increases. To overcome this clamping force, the holder member 16 must be moved upwardly along the guide structure 18. To this end, the operator rotates the lever 26 upwardly so that the clearance surface 22 of the cam 20, which is initially spaced away from the cam engaging surface 96, rotates downwardly toward the cam engaging surface 96. Eventually the edge of the actuating cam surface 24 contacts the cam engaging surface 96 of the mounting structure 15 and lifts the holder member 16 slightly upwardly to overcome the clamping force and release the holder member 16. At this point, the operator of the coin processing machine is also grasping the bag 105 to ensure that it does not fall from the coin chute 12. In this operation, the holder member 16 is released without the operator grasping it whatsoever as the operator instead grasps the lever 26.

The cam 20 does not serve the purpose of fully moving the holding member 16 to its upper position whereby the detent mechanism 40 is actuated, but simply releases the holder member 16 from its clamping position. Of course, a cam could be designed such that it imparts enough vertical movement to the holder member 16 to move the holder member 16 to the fully opened position whereby the detent mechanism 40 is actuated. Also, the cam engaging surface 96 can alternatively be located on one of the outer surfaces 92 and 93 instead of being outside these surfaces. Further, the cam 20 could be connected to a motor which actuates the cam in response to the operator activating the motor through a switch.

In yet another alternative embodiment, a lever can be connected to a cam which resides within the mounting structure 15 adjacent to what is now shown as the cam engaging surface 96. In such an embodiment, the upper portion of the mounting structure 15 would be cammed upwardly to push against the apex of the inner surfaces 90 and 91 of the holder member 16 to move it upwardly along the guide structure 18.

Further, the pair of complementary inner and outer surfaces 90, 92 and 91, 93 could be replaced by one set of complementary surfaces to hold the bag 105. Thus, the cam 20 would be required to release one inner surface from its complementary outer surface. Also, the holder member 16 and the mounting structure 15 may be located slightly away from the coin chute 12 and may be mounted to a structure adjacent to the coin chute 12.

It should also be noted that in some applications the cam 20 may not be necessary. The operator of the machine simply grasps both sides of the holder member 16 and moves it upwardly to overcome the clamping force. Of course, in such an embodiment, the holder member 16 would not require the cam bore 32 (FIG. 1) which receives the cam 20.

FIG. 5 is a cross-section taken along line 5—5 in FIG. 2 where the bag clamping device 10 is in the opened state and the ball 42 of the detent mechanism 40 is residing within the ball recess 50 along the guide structure 18. FIG. 5 also illustrates the fasteners 110 that are used to secure the mounting structure 15 to the coin chute 12. While coins are not normally moving through the coin chute 12 when the bag clamping device 10 is in its opened state, coins are shown in FIG. 5 for clarity to illustrate how they would enter the chute opening 13 and be discharged from the coin chute 12 through the coin chute exit 14.

FIG. 5 further illustrates a coin deflector 115 which distributes the coins throughout the bag 105 (not shown) that is attached to the coin chute 12. In some instances, especially when polymeric bags are used, the coins tend to become stacked in columns directly below the chute opening 14. Thus, the coin deflector 115 also serves the purpose of prohibiting the stacking of coins into the coin chute 12 which may cause the coin processing machine to encounter a coin jam. The coin deflector 115 may also include a sound dampening device 117 on one or both of its sides to help reduce the sound of the coins engaging the coin chute 12. When the sound dampening device 117 is located on the bottom side of the coin deflector 115, it dampens the sound as coins begin to stack up below the exit chute 14. The sound dampening device 117 is typically made of an elastomeric material.

FIG. 5 also illustrates a lower angled portion 120 to the coin chute 12 which assists in placing the bag around the coin chute 12. The lower angled portion 120 tends to keep the bag folds from entering the slot below the coin deflector 115 during bag installation.

FIG. 6 illustrates a pair of side rails 122 of the guide structure 18 which retains the holder member thereon. The rails 122 create a recess 126 on either side of the guide structure 18 into which fingers 125 of the holder member 16 reside. The ball 42 is in its inward position such that it is engaging the guide structure 18 until the holder member 16 reaches its uppermost portion (shown in FIG. 5) where the ball 42 is pushed outwardly under the force of the spring 44 into the ball recess 50.

While the present invention has been described with reference to one or more preferred embodiments, those skilled in the art will recognize that many changes may be made thereto without departing from the spirit and scope of the present invention which is set forth in the following claims.

What is claimed is:

1. A clamping device for a bag to receive coins from a coin exit region of a coin processing machine, comprising:

a mounting structure being located at said coin exit region and having first and second outer surfaces being angled with respect to a vertical line;

a holder member movably mounted with respect to said mounting structure between an opened position and a closed position, said holder member having first and second inner surfaces generally opposing said outer surfaces of said mounting structure in said closed position; and a bag receiving region defined between said first inner and outer surfaces and between said second inner and outer surfaces, said bag receiving region decreasing in size when said holder member is moved from said opened position to said closed position for clamping said bag between said inner and outer surfaces.

2. The bag clamping device of claim 1, wherein said first and second outer surfaces of said mounting structure are generally flat.

3. The bag clamping device of claim 2, wherein first and second inner surfaces of said holder member are generally flat.

4. The bag clamping device of claim 3, wherein said first inner surface and said first outer surface are each generally at a first angle with respect to said vertical line, and said second inner surface and said second outer surface are each generally at a second angle with respect to said vertical line.

5. The bag clamping device of claim 1, wherein said first and second angles are in the range from about 10° to about 15°.

6. The bag clamping device of claim 1, wherein portions of said first and second inner surfaces are roughed to enhance the clamping of said bag.

7. The bag clamping device of claim 6, wherein said roughened portions include knurled cylindrical pins, said knurled cylindrical pins projecting further toward said first and second outer surfaces than remaining portions of said first and second inner surfaces.

8. The bag clamping device of claim 1, wherein said holder member further includes means for toggling an electronic switch in response to said holder member being moved to said opened position.

9. The bag clamping device of claim 8, wherein said switch toggling means includes a magnet mounted to said holder member.

10. The bag clamping device of claim 1, further including means for maintaining said holder member in said opened position.

11. The bag clamping device of claim 10, wherein said maintaining means includes a detent mechanism mounted at least partially on said holder member.

12. The bag clamping device of claim 1, further including means for releasing said holder from said closed state.

13. The bag clamping device of claim 12, wherein said releasing means is manually actuated.

14. The bag clamping device of claim 12, wherein said releasing means includes a cam.

15. The bag clamping device of claim 14, wherein said cam is attached to said holder member and engages a cam surface on said mounting structure.

16. The bag clamping device of claim 1, wherein said coin processing machine includes a coin chute at said coin exit region and said mounting structure is connected to said coin chute.

17. The bag clamping device of claim 1, wherein said coin processing machine includes a coin chute at said coin exit region and said holder member is connected to said coin chute.

18. The bag clamping device of claim 17, wherein said mounting structure is further connected to said coin chute.

19. The bag clamping device of claim 1, wherein said mounting structure has an inverted V-shape defining said first and second outer surfaces, said holder member having a similar inverted V-shaped cut-out defining said first and second inner surfaces.

20. The bag clamping device of claim 1, wherein said coin processing machine includes a coin chute at said coin exit region, said coin chute including an angled rear portion on a side of said coin chute opposing said bag clamping device to assist in placement of said bag therearound.

21. The bag clamping device of claim 1, wherein said mounting structure is stationary.

22. The bag clamping device of claim 1, wherein said coin processing machine includes a coin chute at said coin exit region, said coin chute including means for preventing stacking of said coins within said coin chute.

23. A clamping device for a bag to receive coins from a coin exit region of a coin processing machine, comprising:

first and second opposing surfaces located at said coin exit region and defining a bag receiving region therebetween, at least one of said first and second surfaces being moveable between a closed position wherein said bag is clamped between said opposing surfaces and an opened position wherein said opposing surfaces are spaced away from each other; and a cam for releasing said one of said first and second surfaces from said closed position.

24. The bag clamping device of claim 23, further including a lever connected to said cam for manual rotation of said cam.

25. The bag clamping device of claim 23, wherein said other of said first and second opposing surfaces is stationary.

26. The bag clamping device of claim 25, wherein said cam engages a structure fixedly mounted with respect to said other of said first and second opposing surfaces.

27. The bag clamping device of claim 23, wherein said cam moves said moveable one of said first and second opposing surfaces only partially toward said opened position.

28. The bag clamping device of claim 23, further including a guide track for slidably moving said one said first and second opposing surfaces toward said opened state.

29. The bag clamping device of claim 28, wherein said guide track includes a detent member for locking said other one of said first and second surfaces in said opened position.

30. The bag clamping device of claim 23, wherein said cam has a generally semi-circular cross sectional shape.

31. The bag clamping device of claim 23, wherein said cam engages a surface that is located outside of said first and second opposing surfaces.

32. A clamping device for a bag to receive coins from a coin exit region of a coin processing machine, comprising:

a mounting structure being located at said coin exit region and having generally an inverted V-shape defining two outer surfaces;

a holder member movable between an opened position where said holder member is located away from said mounting structure and a closed position wherein said holder member at least partially overlays at least a portion of each of said two outer surfaces of said mounting structure, said holder member and said mounting structure clamping said bag in said closed position; and a cam being adapted to release said holder from said closed position.

33. The bag clamping device of claim 32, wherein said outer surfaces are generally flat.

34. The bag clamping device of claim 32, wherein said outer surfaces are at an angle with respect to said vertical line, said angle being in the range from about 10° to about 15°.

35. The bag clamping device of claim 34, wherein said holder member has two flat inner surfaces.

36. The bag clamping device of claim 35, wherein said flat inner surfaces are inclined at approximately said angle with respect to said vertical line.

37. The bag clamping device of claim 32, wherein said cam is attached to said holder member and engages a cam surface on said mounting structure.

38. The bag clamping device of claim 32, wherein said coin processing machine includes a coin chute at said coin exit region, said mounting structure and said holder member being connected to said coin chute.

39. A method of releasing a coin bag from a bag clamping device located on a coin processing machine, said bag clamping device including first and second opposing surfaces between which said bag is clamped, comprising:

providing a cam adjacent to said opposing surfaces; and rotating said cam so as to move said opposing surfaces away from each other.

40. The method of claim 39, wherein said step of rotating said cam includes engaging a structure fixedly mounted with respect to one of said opposing surfaces.

41. The method of claim 39, wherein said cam has a generally semi-circular cross sectional shape.

42. The method of claim 39, wherein said step of rotating is through manual rotation of said cam.

43. The method of claim 39, wherein one of said opposing surfaces is stationary.

* * * * *